United States Patent [19]

Bouck

[11] 4,415,034

[45] Nov. 15, 1983

[54] ELECTRODE WELL COMPLETION

[75] Inventor: Larry S. Bouck, Tulsa, Okla.

[73] Assignee: Cities Service Company, Tulsa, Okla.

[21] Appl. No.: 374,581

[22] Filed: May 3, 1982

[51] Int. Cl.[3] ..... E21B 36/04; E21B 43/24

[52] U.S. Cl. ..... 166/302; 166/60; 166/248

[58] Field of Search ..... 166/248, 272, 288, 302, 166/57, 58, 59, 60, 65 R

[56] References Cited

U.S. PATENT DOCUMENTS

| | | | |
|---|---|---|---|
| 2,795,279 | 6/1957 | Sarapuu | 166/248 |
| 2,889,882 | 6/1959 | Schleicher | 166/248 |
| 2,914,309 | 11/1959 | Salomonsson | 166/59 X |
| 3,106,244 | 10/1963 | Parker | 166/248 |
| 3,137,347 | 6/1964 | Parker | 166/60 X |
| 3,211,220 | 10/1965 | Sarapuu | 166/248 |
| 3,236,304 | 2/1966 | Sarapuu | 166/60 X |
| 3,476,184 | 11/1969 | Davis, Jr. | 166/273 |
| 3,483,926 | 12/1969 | Bruist | 166/288 |
| 3,547,192 | 12/1970 | Claridge et al. | 166/248 |
| 3,698,478 | 10/1972 | Parker | 166/248 |
| 4,030,549 | 6/1977 | Brouck | 166/248 X |

*Primary Examiner*—Stephen J. Novosad
*Assistant Examiner*—George A. Suchfield
*Attorney, Agent, or Firm*—George L. Rushton

[57] ABSTRACT

The electrode of an electrode well is formed by inserting a heating device into the borehole and heating the surrounding formation to a temperature at which the hydrocarbon-containing material undergoes thermal cracking, resulting in a coke-like residue surrounding the heater. This conductive and permeable carbonized material serves as an electrode of enlarged radius for further electroheating of the formation.

7 Claims, 7 Drawing Figures

AT THE END OF THE COKE-PRODUCING PROCESS

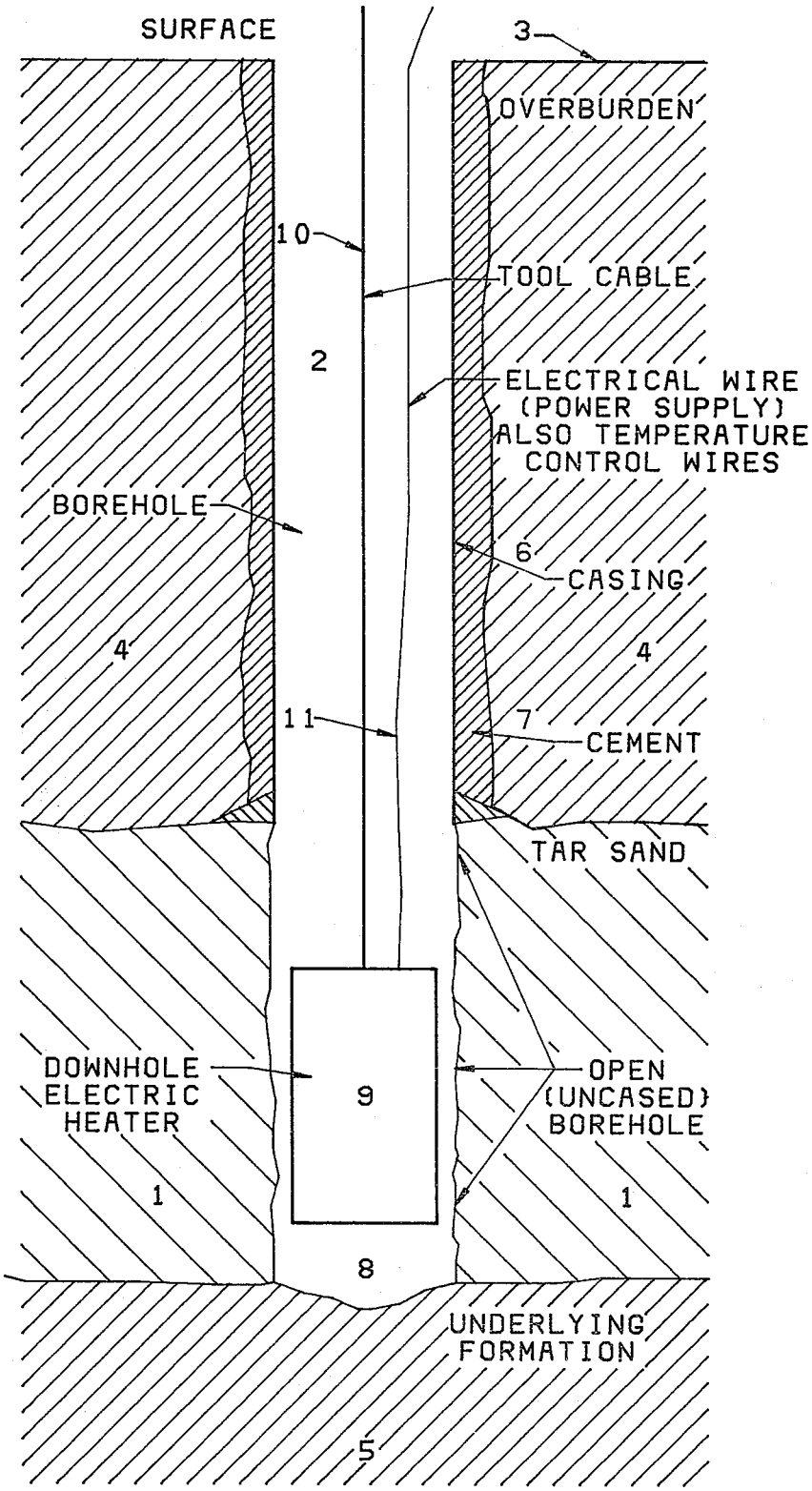
FIG. I
CROSS SECTION OF BOREHOLE AT THE INITIATION OF THE COKING PROCESS

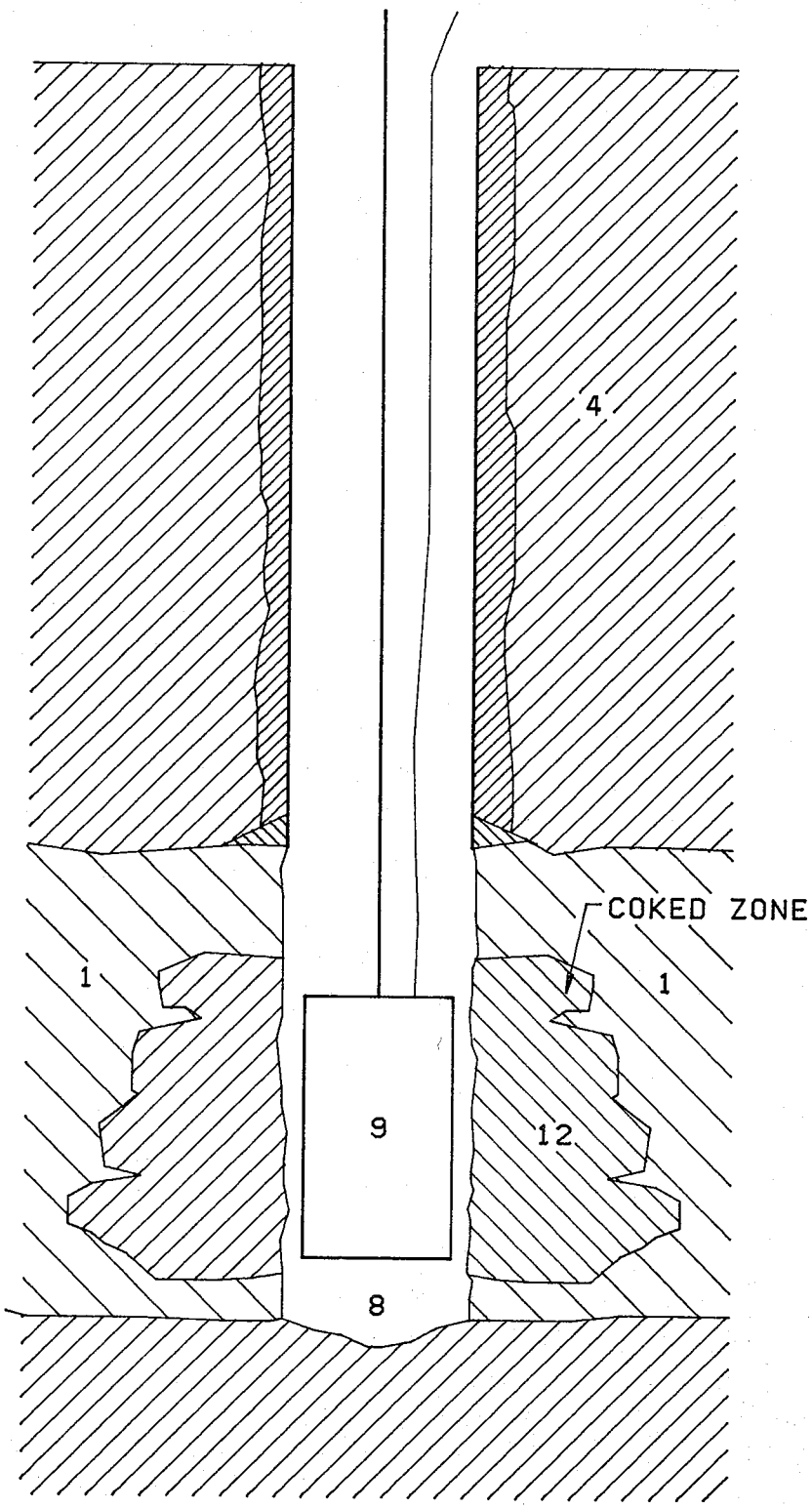
FIG. II
AT THE END OF THE COKE-PRODUCING PROCESS

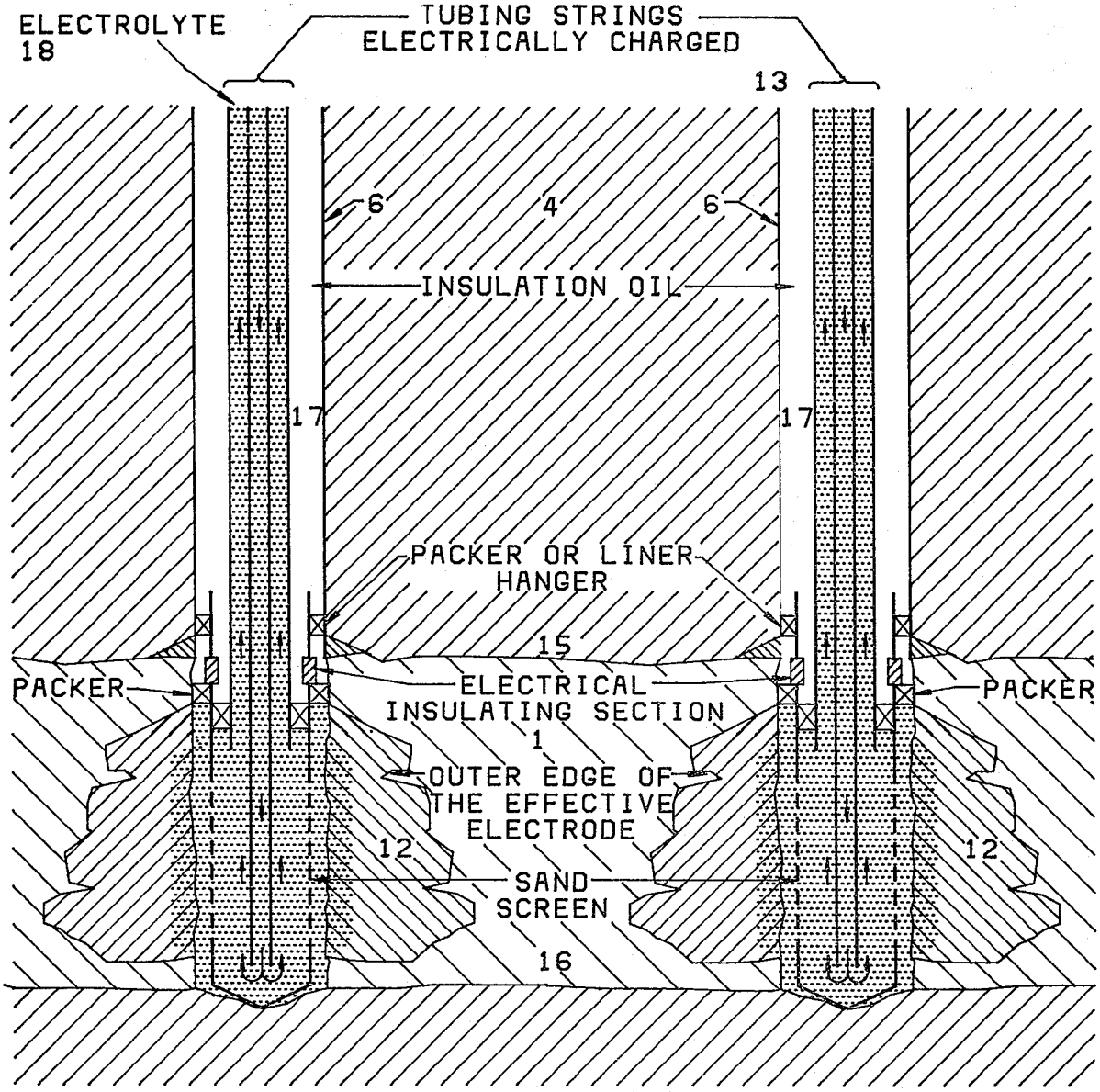
FIG. III
ELECTRODE WELLS WITH ELECTRODES OF
ENLARGED EFFECTIVE RADIUS

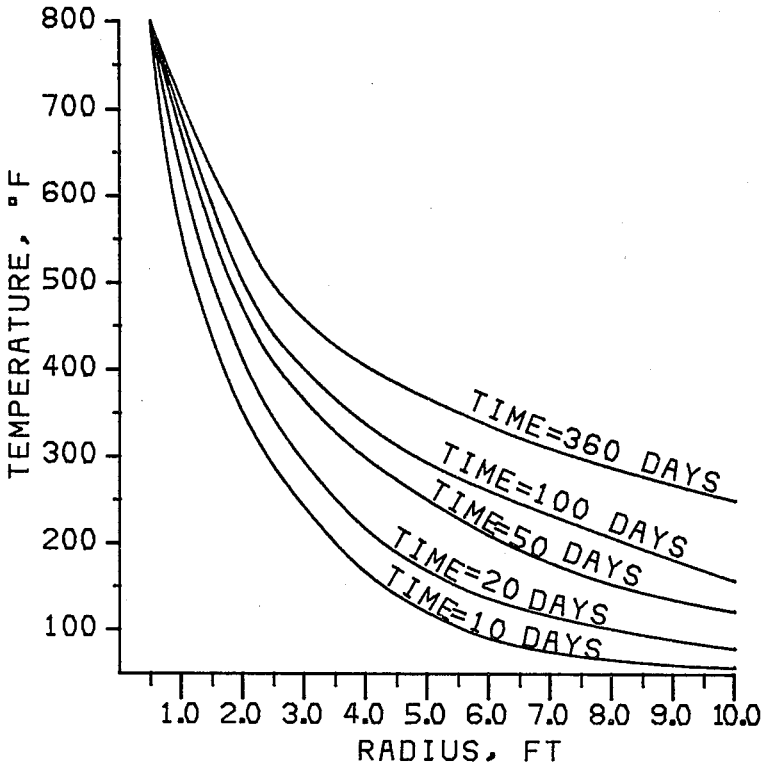
FIG. IVa
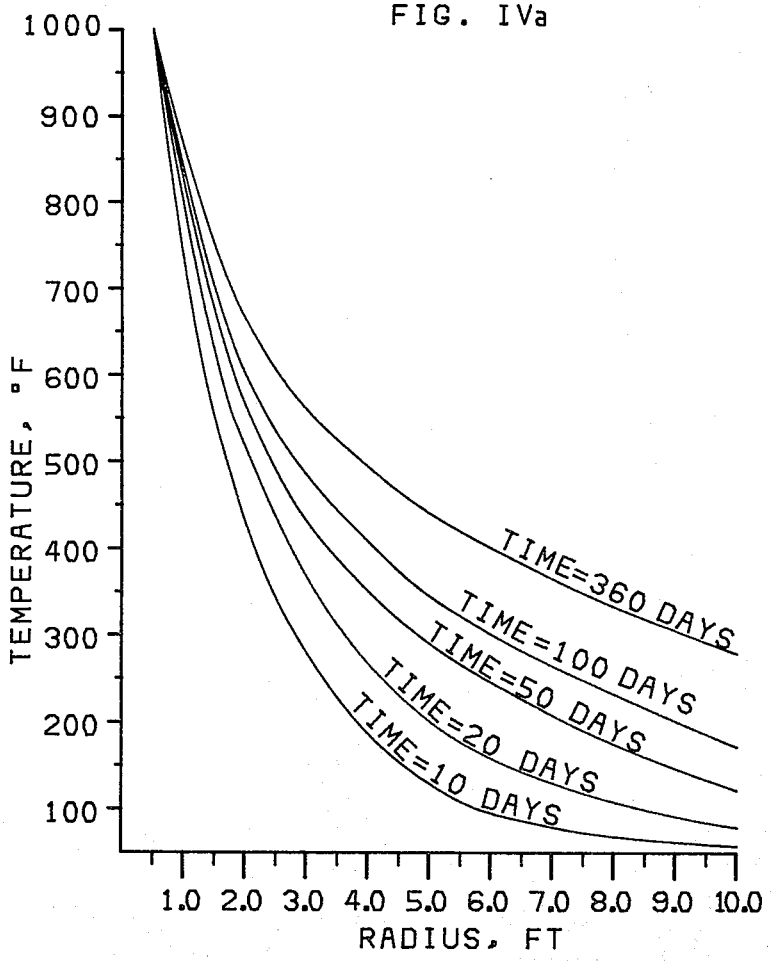
FIG. IVb

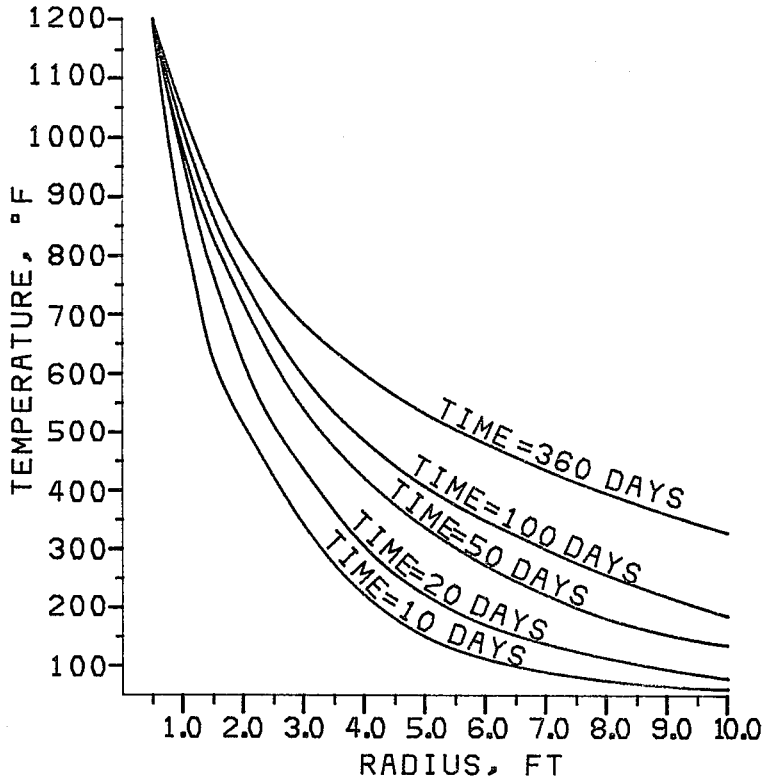
FIG. IVc
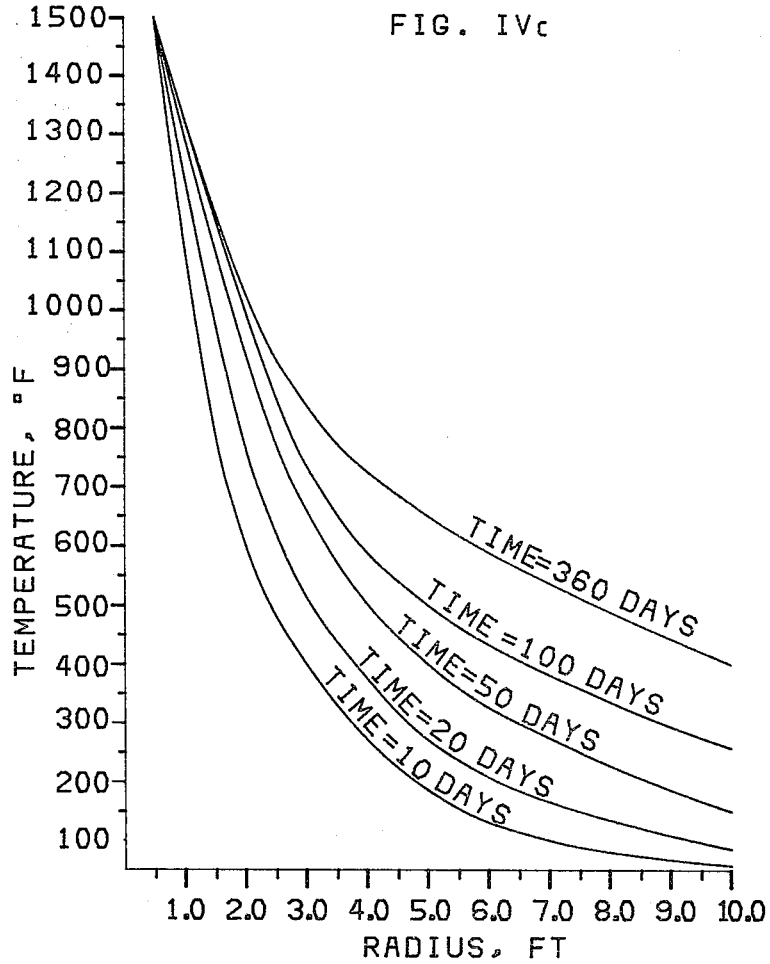
FIG. IVd

ELECTRODE WELL COMPLETION

BACKGROUND OF THE INVENTION

This invention relates generally to (a) a method for heating a hydrocarbon-containing subterranean formation to develop a zone containing carbonized material in the pore spaces and (b) the mineral formation containing carbonized material in the pore spaces resulting from the heating process.

More particularly, the invention relates to a method for creating a carbonaceous current-carrying deposit in a formation surrounding a borehole, and to the enlarged-radius electrode thus formed from the deposit. A borehole that is completed as a well and having appropriate electrical features so that it can function as an electrode in contact with the adjacent formation is known as an electrode well. The utility of the invention lies in the heating, by electrical means, of a subterranean formation, between two or more boreholes, as the step following the formation of the carbonaceous electrode.

Broadly, when an electrical current is used in a subterranean formation to heat the formation, it is desirable to have an electrode of substantial size. If small electrodes are used, a high current density develops, which leads to a high temperature in the vicinity of the electrode. This high temperature vaporizes or flashes the connate brine or water, with said flashing effectively removing some of the electrolyte present, thus reducing the conductivity and even leading to an interruption of the process. The flash temperature depends on the depth of the electrode and, broadly, can vary from about 220° to about 600° F. (104°–315° C.). In an effort to overcome the problem of flashing, and thus the reduction in electrical conductivity, previous schemes have suggested injecting metal or graphite particles into the formation to keep the current path open and reduce the current density, thus delaying the onset of the flashing phenomenon. U.S. Pat. No. 3,848,671 (Kern) concerns a method of producing bitumen in which injection and production wells are completed, and the formation is heated by passing electricity between electrodes positioned in each well. As mentioned above, the Kern process has the limitation that during heating, the temperature immediately adjacent the wells must not be so high as to cause evaporation of the water envelopes, at the pressure found in the formation. U.S. Pat. No. 3,958,636 (Perkins) produces bitumen from a tar sand formation while heating the formation by electrical conduction between a plurality of wells. A high back pressure is maintained on the wells and an immiscible fluid is injected into the formation through one of the wells. However, like the above Kern patent, Perkins discloses that during heating, the temperature in the regions of highest current densities, that is, in the regions immediately about and adjoining the wells, should not be so high as to cause evaporation of the water envelopes at the pressure that is sustainable by the overburden. This means that the electrical current should be maintained low enough to prevent drying of the tar sand formation around the wells. U.S. Pat. No. 3,931,856 (Barnes) increases the "size" of the electrode used in heating by providing a larger area of high electrical conductivity. This is done by having an electrode well adjacent a satellite well. Preliminary heating of the formation between these wells mobilizes the viscous oil, and it is removed. Then, water containing an electrolyte is circulated between the electrode and satellite wells, effectively increasing the "size". U.S. Pat. No. 3,874,450 (Kern) enlarges an electrode by having an upper section of conductive casing in a vertical wellbore with a lower section of nonconductive casing. The bottom of the wellbore has a deviated section extending laterally from the vertical axis of the bore in a predetermined direction. This deviated section contains an electrode and is filled with electrolyte. When electricity is applied to the wellbore, current flows between the upper section and the deviated section, thus heating the formation over a larger volume than is possible by prior methods. This deviation operation necessitates additional drilling variables and complicates the wellbore completion, resulting in additional expense. The Kern '671 and Perkins methods are careful to point out that, during formation heating, the temperatures adjacent the electrode wells must not be so high as to cause evaporation of the water envelopes.

SUMMARY OF THE INVENTION

My invention concerns a method for creating an electrode of enlarged effective radius, for further use in a process involving the use of electric currents to heat a subterranean, hydrocarbon-bearing formation. Heating of the formation improves the recovery of hydrocarbons through mechanisms such as viscosity reduction or hydrate decomposition.

My invention comprises a process for creating an effective electrode of enlarged radius, said electrode being a carbonaceous, current-carrying deposit, in a subterranean, hydrocarbon-bearing formation surrounding the electrode, having the serial steps of:

(a) forming a borehole in the hydrocarbon-bearing formation, (b) placing a heating device in said borehole, (c) energizing the device to heat the surrounding formation to a temperature high enough to produce coking of at least a portion of the hydrocarbon-bearing formation, and (d) maintaining the temperature of step (c) for a length of time to obtain the current-carrying electrode of desired radius.

The invention also comprises the electrode of enlarged effective radius resulting from the above-described process.

During the coking step of the process, any water present is vaporized. Similarly, the light ends of the hydrocarbonaceous formation are vaporized. After the vaporized water and light ends are removed, heating is continued until extensive thermal cracking of the hydrocarbon portion of the formation occurs, with the resultant production of coke or coke-like material. As a result, the formation surrounding the borehole becomes more permeable. This permeability can be utilized later when an electrolyte solution is injected into the electrode. The enlarged effective electrode resulting from the above-mentioned steps is now appreciably larger than the original borehole and can be energized to heat the surrounding formation. If desired, concentrated electrolyte, such as brine, can be injected into the permeable deposit to assist in the later operation of the current-carrying electrode. When this process, involving the formation of a borehole and the creation of a carbonaceous, current-carrying electrode, is repeated in a second borehole spaced apart from the first borehole, it is possible to enlarge the effective radii or diameters of the respective borehole electrodes so that, when current is passed through such a formation between the two electrodes, the mid-point temperature of the formation (which is the minimum temperature between the electrodes) is increased to where the hydrocarbon portion of the formation becomes mobile. This mobile material can then be displaced from the formation by injecting a drive fluid.

DESCRIPTION OF THE DRAWINGS

FIG. I shows a cross-section view of a borehole at the initiation of the coking process.

FIG.II shows a cross-section view of the borehole at the end of the coke-producing process.

FIG. III shows an embodiment of the completed invention, a cross-section view of two electrode wells, each having an enlarged effective radius.

FIGS. IV (*a, b, c, d*) show the temperature in the tar sand formation at varying distances from the outer edge of the borehole after the heater is activated, assuming a diameter of two feet for the borehole and associated heater. FIG. IV*a* shows how the formation is heated, at varying distances and over varying times, when the electric heater maintains a temperature of 800° F. (426° C.) FIGS. IV*b, c,* and *d* are similar graphs showing formation temperature when the heating device maintains temperatures of 1000°, 1200°, and 1500° F. (538°, 649°, 815° C.), respectively.

The drawings are not in proportion.

DETAILED DESCRIPTION OF THE INVENTION

The process of creating an electrode of enlarged radius can be carried out in a number of underground formations. Since the process involves coking of a hydrocarbon-bearing formation, it is evident that the formation must contain material that can be transformed into coke or a coke-like material. This coke-like material is carbonaceous in substance and typically has a permeability greater than that of the original formation. Underground formations that are amenable to the purpose of this invention are those comprising tar sand, oil shale, and heavy oil deposits, such as those found in Canada and in the Orinoco Basin.

One embodiment of the invention is noted in FIG. I, which shows the borehole at the initiation of the coking process. For this embodiment, a tar sand formation 1 is shown as the underground formation. Borehole 2 is drilled from surface 3 through overburden 4 and through the tar sand formation 1 at least partially into the underlying formation 5. The details of drilling a borehole are well-known and need not be discussed here. After the borehole has been drilled, suitable casing 6 is set in the overburden and cemented 7 in place, leaving the open borehole 8 in tar sand formation 1 uncased, since the invention is directed toward the formation of an electrode of a large effective radius in a hydrocarbon-bearing formation. Then, as is well known in the petroleum industry, a downhole heating device, exemplified by an electric heater 9, is placed in the open borehole 8 of tar sand formation 1. Heating device 9 is connected to and suspended from surface 3 by tool cable 10. Heating device 9 is also connected to a source of power (not shown on surface 3) by an electrical cable 11, comprising power supply wires, temperature control wires, and other necessary electrical fittings.

The heating device used in the process can be any of a variety of such devices. Although an electric heater is shown in FIG. 1, a down-hole combustion device, such as a propane burner, can be used to heat the surrounding formation. Other possible heating devices include those using the thermite process or a nuclear device. The size, shape, and type of device used is not critical, as long as a sufficient and controlled supply of heat energy can be applied to the formation surrounding the borehole. The heating device is placed in that portion of the formation where the ultimately-formed electrode is desired. Since these devices are subject to high temperatures, with resultant stress and corrosion, the devices are usually used for forming one electrode and are then discarded.

In prior methods using electrical heating of an underground formation, the presence of connate water in the formation has been noted. These prior processes are controlled so that the connate water is not heated to a temperature which will cause disappearance of the water, such as vaporization. The loss of such water in the formation renders the formation appreciably non-conductive, thereby reducing the utility of the resistance heating process.

On the other hand, in the present process, a heating device is controlled at a temperature such that thermal cracking occurs in at least a portion of the hydrocarbon-bearing formation surrounding the heating device. As a consequence of this cracking temperature, nearby formation water is vaporized, and products of thermal cracking, such as light ends, are produced. These vapors and gases can be removed, if necessary, through the borehole. Particles of coke, or thermocracked carbonaceous material, are produced by these high temperatures, typically greater than 500° F. (260° C.) Porosity is developed in the coke, so that the particles allow the inflow of brine. Thus the coked portion, containing brine, has improved characteristics as an electrode. This carbonaceous, current-carrying electrode is formed in place and retains many of the chemical and physical properties of the original formation.

FIG. II represents the formation surrounding heating device 9 at the end of the coke-producing process. The coked zone 12 is substantially cylindrical in shape, generally following the shape of the heating device. This coked zone 12 can be considered the raw material for, or the precursor of, the effective electrode of enlarged radius which is used in a subsequent operation for electrically heating a larger portion of the formation.

There are many variables that enter into the process of the invention, such as the geology of the hydrocarbon-bearing formation, the thickness of the formation, the temperature and time necessary for cracking the hydrocarbon-bearing portion, and the ultimate effective radius of the electrode to be formed. The radius of the original borehole, and thus the radius of the heating device, can vary from about 2 inches (5 cm) to about 2 feet (61 cm). The radius of the electrode produced as a result of the process can vary from about 2 feet (61 cm) to about 10 feet (305 cm). The temperature of the heating device should be at least about 800° F. (426° C.), preferably in the range of 1,000°-1,500° F. (538°-815°), and the time necessary to produce an electrode of the desired radius can vary from about 1 to about 12 months.

These time-temperature-radius factors are related as shown in FIG. IV. These graphs show how effectively the heater in the borehole, at a given temperature, transmits heat to the surrounding formation over varying periods of time. The graphs are based on data for heat transference through an idealized formation, assuming a borehole (and heater) of 2 feet diameter. Therefore the graphs are meant to show approximate parameters. For example, from FIG. IV*a*, if the borehole heater is maintained at 800° F. (426° C.), after 100 days, the formation temperature 5 feet from the center of the borehole (or 4 feet from the outside of the heater) is about 300° F. (149° C.). If it is assumed that substantial coking of the formation takes place above about 500° F. (260° C.), FIG. IV*a* indicates that this temperature is reached at a distance of about 2.5 feet from the center of the borehole after about 1 year of heating. On the other hand, if the heater is at 1000° F. (538° C.) (FIG. IV*b*) for about 1 year, this coked zone (temperature of about 500° F. (260° C.)) radius is about 4 feet. From FIG. a zone radius of about 4 feet is reached after about 100–120 days when the heater is about 1200° F. (649° C.). And a heater temperature of about 1500° F. (815° C.) (FIG. IV*d*) maintained for about 1 year results in a formation temperature of about 500° F. (260° C.) about 7.6–7.8 feet from the center of the borehole.

These graphs are used as guides for the formation of electrodes of varying sizes.

FIG. III shows a cross-section of two completed wells, wherein sufficient work has been done on the boreholes to carry out a subsequent heating operation. Tubing strings 13, connected to a proper power source (not shown), are inserted into the boreholes and separated by packing devices from casings 6 and the formation 1. Further, electrical insulating sections 15 are used to insulate the lower metallic portion of each borehole fitting from each casing 6.

Sand screens 16 are inserted, by means well known in the petroleum industry, in the lower portion of each borehole to provide ingress and egress of liquids and vapors between formation 1 and the borehole. Insulating oil 17 is added to the upper portion of each borehole to insulate the charged tubing string 13 from casing 6 and surrounding overburden 4. To provide good electrical contact with formation 1 and to act as a coolant, an electrolyte 18 such as brine, can be forced down each inner tubing string and returned to the surface through each outer tubing string. Some electrolyte flows through the openings of sand screens 16 and enters coked zones 12. Then, during a subsequent process, when electric energy is applied to the lower portion of each borehole, each coked zone 12 becomes an effective electrode of enlarged radius.

Coked zone 12 has a degree of porosity and permeability related to the original formation. Coke particles (or carbonaceous particles) formed by the in-situ heating of the tar sand are distributed in the pores of the formation, and these particles partially fill the pores. Generally, the pores are connected so that there is a continuous path for the conduction of electricity.

I claim:

1. A process for creating an effective electrode of enlarged radius, said electrode being a carbonaceous, current-carrying deposit in a subterranean, hydrocarbon-bearing formation surrounding the electrode, having the serial steps of:

(a) forming a borehole in the hydrocarbon-bearing formation, (b) placing a heating device in said borehole, (c) energizing the device to heat the surrounding formation to a temperature high enough to produce coking of at least a portion of the hydrocarbon-bearing formation, and (d) maintaining the temperature of step (c) for a length of time to obtain the current-carrying electrode of desired radius.

2. The process of claim 1 wherein, further, the enlarged effective electrode radius is energized by electrical means to heat additional surrounding formation, thus raising the temperature of the surrounding formation.

3. The process of claim 1, wherein the temperature of the heating device is from about 800° F. (426° C.) to about 1500° F. (815° C.).

4. The process of claim 1, wherein an electrolyte is placed in the borehole and flows into the effective electrode.

5. The process of claim 1, wherein the effective electrode of enlarged radius is larger in diameter than the borehole.

6. A carbonaceous, current-carrying electrode, formed in a subterranean, hydrocarbon-bearing formation by the steps of:

(a) forming a borehole in the hydrocarbon-bearing formation, (b) placing a heating device in said borehole, (c) energizing the device to heat the surrounding formation to a temperature high enough to produce coking of at least a portion of the hydrocarbon-bearing formation, and (d) maintaining the temperature of step (c) for a length of time to obtain the desired electrode radius.

7. The electrode of claim 6, having a radius of from about 2 feet to about 10 feet, and having a generally cylindrical shape.

* * * * *